US009295345B2

(12) United States Patent
Winters

(10) Patent No.: US 9,295,345 B2
(45) Date of Patent: Mar. 29, 2016

(54) OPEN AIR FOOD DISPLAY CASE WITH AUTOMATIC CLOSING MECHANISM

(71) Applicant: Sanden Vendo America, Inc., Dallas, TX (US)

(72) Inventor: Robert Scott Winters, Keller, TX (US)

(73) Assignee: SANDEN VENDO AMERICA, INC., Dallas, TX (US)

( * ) Notice: Subject to any disclaimer, the term of this patent is extended or adjusted under 35 U.S.C. 154(b) by 0 days.

(21) Appl. No.: 14/226,692

(22) Filed: Mar. 26, 2014

(65) Prior Publication Data

US 2015/0272347 A1 Oct. 1, 2015

(51) Int. Cl.

| | |
|---|---|
| ***G08B 17/06*** | (2006.01) |
| ***A47F 3/04*** | (2006.01) |
| ***E05B 65/00*** | (2006.01) |

(Continued)

(52) U.S. Cl.

CPC ..... *A47F 3/0478* (2013.01); *A47F 3/0439* (2013.01); *A47F 3/0469* (2013.01); *E05B 65/0021* (2013.01); *E05B 65/0042* (2013.01); *G08B 21/182* (2013.01); *E05B 47/0004* (2013.01)

(58) Field of Classification Search

CPC . G07F 9/105; F25D 2700/12; F25D 2700/16; F25D 2400/36

USPC ..... 340/593, 539.23, 545.1, 546.6, 691.6; 62/127, 129, 156

See application file for complete search history.

(56) References Cited

U.S. PATENT DOCUMENTS

| | | | |
|---|---|---|---|
| 4,927,051 | A | 5/1990 | Falk et al. |
| 5,360,134 | A | 11/1994 | Falk et al. |

(Continued)

FOREIGN PATENT DOCUMENTS

| | | | |
|---|---|---|---|
| EP | 2045785 | A2 | 4/2009 |
| NL | 1024563 | C2 | 4/2005 |

OTHER PUBLICATIONS

Proposed Revisions to the NAMA Construction Standard for Unattended Location Refrigerated Display Cases used in Micro Markets, AMHIC Meeting, Apr. 26, 2013.

(Continued)

*Primary Examiner* — Phung Nguyen

(74) *Attorney, Agent, or Firm* — Mark D. Miller; William K. Nelson

(57) ABSTRACT

The present invention includes various types of open-air display cases for displaying, storing, and/or vending food, beverages, or other products having a movable barrier that can be automatically positioned over an open front or side of such a unit to prevent access to the products therein when temperatures or other conditions reach unacceptable levels, and methods of using such units. Embodiments of such units may include a temperature-controlled compartment having an open front or side for displaying items, an automatic barrier system that includes a barrier for covering the open portion, a motor engaged with the barrier for closing or opening the barrier, at least one sensor for measuring at least one internal condition (e.g., temperature) of the temperature-controlled compartment, and a processing unit in electronic communication with the sensor and the motor, in which the processing unit may receive data from the sensor, compare the data to a pre-determined range of acceptable values, and activate the motor to close the barrier when the data is inconsistent with the pre-determined range of acceptable values.

26 Claims, 3 Drawing Sheets

(51) Int. Cl.
*G08B 21/18* (2006.01)
*E05B 47/00* (2006.01)

(56) References Cited

U.S. PATENT DOCUMENTS

| | | | | |
|---|---|---|---|---|
| 5,799,822 | A * | 9/1998 | Rudewicz et al. | 221/150 HC |
| 6,011,243 | A | 1/2000 | Arnold et al. | |
| 6,102,162 | A | 8/2000 | Teicher | |
| 6,131,399 | A * | 10/2000 | Hall | 62/127 |
| 6,789,392 | B1 * | 9/2004 | Miller et al. | 62/130 |
| 6,990,821 | B2 | 1/2006 | Singh et al. | |
| 8,063,735 | B2 * | 11/2011 | Shoenfeld | 340/5.73 |
| 2009/0277199 | A1 * | 11/2009 | Manas et al. | 62/129 |
| 2012/0176245 | A1 | 7/2012 | Paydar et al. | |
| 2012/0203377 | A1 | 8/2012 | Paydar et al. | |

OTHER PUBLICATIONS

Klinkers, Frans J., Vending machine for hot or cold food products, blocks compartment door when product inside is no longer fresh, English Abstract of Netherlands Patent Publication NL1024563, Apr. 20, 2005, European Patent Organization, http://www.epo.org/searching/free/espacenet.html.

* cited by examiner

SECTION A-A

SECTION B-B

DETAIL "C"

OPEN AIR FOOD DISPLAY CASE WITH AUTOMATIC CLOSING MECHANISM

FIELD OF THE INVENTION

The present invention relates to open-air display cases, and more particularly to automated barrier systems to close open-air display cases to prevent customers from receiving spoiled, expired, or contaminated food or other goods, and related methods of operation.

BACKGROUND

Open-air temperature-controlled (e.g., refrigerated) display cases are used in certain commercial establishments for storage and display of food or other perishable products, usually at temperatures at a desired level (e.g., lower than ambient temperature). Such display cases ordinarily have a refrigerated display chamber with thermally isolated walls, an open front or side, and various display features (e.g., shelves) for holding and displaying food, beverages and/or other products.

Businesses may use such open-air temperature-controlled units to offer limited food and beverage options to employees, customers or staff in such settings as company cafeterias, break rooms, convenience stores, coffee shops, etc. Open-air units allow such businesses to offer fresh foods, snacks, and beverages or other perishable products in an inviting, easily accessible, and more aesthetic manner than traditional vending machines. The units may also be used in unmanned, self-service markets, in which customer may shop and check out via a self-checkout kiosk without the need for a cashier or clerk. For example, a customer can pick up a product from the open-air refrigeration unit display, and then scan a bar code or an RFID tag for each product at a payment kiosk. Such unmanned market systems are highly efficient and can reduce costs for businesses (e.g., a business may offer the unmanned market to their employees in a break room or cafeteria), while providing convenience as well as potentially healthier and more desirable food, beverage and other product options than traditional vending machines.

However, because such open-air units are not closed systems, they pose a risk that the temperature within the unit may rise above an acceptable level and possibly cause spoilage of the food, beverages and/or products contained therein. Businesses that offer food and beverages using the open-air coolers are often required to meet health regulations and protect consumers from spoiled food and foodborne illness. Similarly, non-food products that are exposed to excessive temperatures may melt, change form or otherwise become useless or non-functional.

Conventional open-air display units do not include a mechanism for automatically closing or restricting access to the food or beverages contained therein when temperatures or other conditions reach an unacceptable level. Such automation is desirable for both unmanned markets and manned eateries because of the risk of foodborne illnesses and because monitoring food temperature and condition is a tedious and time-consuming task. Thus, there is a need for an automated mechanism for restricting access to an open air cooler or display unit that is triggered when conditions (e.g., temperature) within the unit reach unacceptable levels for the food, beverages or other items in the unit.

SUMMARY OF THE INVENTION

The present invention provides methods and apparatus for automatically closing open-air display units when undesirable conditions are detected in the units. Embodiments of the invention have an automatic barrier system that is triggered when conditions within the units, such as excessive temperatures for extended time periods, are encountered. The open-air units described herein are designed to protect consumers by restricting and/or preventing access to products inside the units, such as food, beverages or other items, when unacceptable conditions in the units are detected. For example and without limitation, an automatic barrier system may be activated when the conditions within an open-air unit are such that food and beverages stored therein may spoil (e.g., unacceptably high temperature). To enable the automation of the barrier system, the open-air units of the present invention may be operable to monitor temperature and other conditions within the unit, and activate the barrier system when conditions in the open-air unit reach unacceptable levels. The present invention also concerns methods of operating and using automatic barriers for such open-air units.

Embodiments of the automated barrier system of the present invention may include one or more sensors for monitoring the internal environment of the open-air unit, including without limitation one or more of the following: temperature sensor(s), light sensor(s), barometric sensor(s), humidity sensor(s), motion sensor(s), etc. The sensor(s) may be in electronic communication with a processing unit capable of analyzing the data from the sensor(s) and activating the lock-out system, when the sensor data indicates that the conditions in the open-air units are unacceptable. Embodiments of the processing unit may be a computer housed within the cooler unit, or a remote computer having a wired or wireless connection to the electronics and sensor(s) of the cooler unit. Such a computer may include software capable of comparing the data from the sensor(s) to one or more pre-determined standards stored in an internal memory. For example, the processing unit or controller may compare temperature data received from one or more temperature sensors in the cooler unit to a threshold temperature stored in the internal memory of the processing unit. A temperature higher than the threshold temperature may indicate that the food and/or beverages stored in the cooler unit may begin to spoil, and the processing unit may be programmed to activate the automated barrier system when it receives temperature data above the threshold. The processing unit may be programmed to monitor more than temperature alone (e.g., it may monitor UV light conditions, humidity, etc.), and the criteria for activating the automated barrier mechanism may include various combinations of different kinds of data (e.g., temperature, UV light conditions, humidity, etc.) received from different kinds of sensors. Embodiments of the software stored in the processing unit may include one or more digital processing algorithms that the processing unit can carry out to analyze various combinations of data and compare them to ranges, sets, and/or matrices of unacceptable combinations of conditions ("spoilage conditions"), and then activate the barrier system when spoilage conditions are present.

Embodiments of the processing unit may also store temperature data in the internal memory of the processing unit, along with data correlated to the temperature, such as the times of temperature readings, the exterior temperature at the times of the internal temperature readings, light conditions (e.g., in systems that include light meters or sensors) at the times of the temperature readings, activity of the compressor or other cooling apparatus of the open-air unit at the times of the internal temperature readings, and other similar information.

Embodiments of the automated barrier system may include a barrier, a track for guiding the barrier, and a motor for driving the barrier along the track. Embodiments of the barrier may be made from various materials, including various sturdy fabrics, insulative foams or rubber, plastics, metals, composite materials, paneling, acrylics, and various combinations of materials. The material of the barrier may be selected based on the expected use with the open-air unit. For example and without limitation, if the function of the barrier is simply to deter customers from purchasing or consuming food and/or beverages stored within the cooler (i.e., for the customers' protection), without concern over potential theft of merchandise, the barrier may not need to be a substantial physical barrier, but merely a sheet of fabric, foam, or other flexible material. The barrier may additionally include a warning thereon (e.g., a written message or warning symbol) indicating that the products therein may have spoiled. In other situations where it is desirable to prevent any access to the open-air unit (e.g., where spoilage warnings may not be understood or heeded, or the unit is part of a restaurant or micro-market that is open to the general public such as in an airport) or if theft is a concern, the barrier may be more substantial (e.g., a rolling steel door), and may have dual functions of (1) restricting access to food in the unit that may be spoiled and/or (2) locking up the unit at times when the restaurant or micro-market closes to the public.

In some embodiments, and without limitation, the barrier material may be flexible (e.g., a sheet or curtain of flexible fabric, foam, rubber, etc.) or segmented (e.g., a rolling steel door) to allow the barrier to be stored in a rolled, compact condition. In such embodiments, the barrier may be collected on a spool or roller when the barrier is in the open position. In other embodiments, the barrier may be unitary structure such as a single rigid piece of material, a form-fitting lid with edges that engage the edges of the open-air unit, a curved piece of plastic, glass, paneling, or metal that can be opened, raised or retracted into a slot or recess in the superior portion of the cooler, and which may be moved, lowered or guided along one or more tracks into a closed position.

For example, the barrier may be mounted on tracks (e.g., vertical or curvilinear tracks) positioned along the lateral sides of an open front of the unit, and the tracks may meet with a receiving surface on a portion of the unit below the open front of the cooler unit (e.g., a partial exterior wall below the front opening of the display compartment). The receiving surface may have a recess therein for receiving a lower portion of the barrier. For example, and without limitation, the receiving surface may have a recess or pocket therein that is complementary to the distal end of the barrier. In some implementations, the barrier may be a curtain having a rigid member (e.g., weight bar) at its bottom that fits into the recess in the receiving surface when the curtain is in a closed position. The rigid member may be engaged with the tracks such that the rigid member is guided by the tracks into the recess in the receiving surface. In other embodiments, the barrier may include multiple rigid components or segments (e.g., a steel roll door or a panel door) which may be engaged with the tracks, which guide a distal component or segment of the barrier to the receiving surface or a recess therein. Once it is has reached the recess or the receiving surface, the rigid member or distal component may then be locked into place to keep the barrier closed.

In some embodiments, and without limitation, the barrier may have multiple wheels, bearings, or other track engagement means along both lateral sides thereof for engaging the tracks. The track engagement means may be nested within the track, so that the track engagement means help to guide the barrier as it moves along the tracks and the barrier is engaged with the tracks at multiple points along its length. It is preferred that there be no gaps in the connections between the track engagement means to prevent an unauthorized person from accessing the display compartment by reaching between the track and the barrier when the barrier is in the closed position.

In some embodiments, the track may be outfitted with one or more safety sensors (e.g., photoelectric sensors) along the track for detecting whether someone is reaching into the display compartment or something is in the way of the barrier, and signaling the processing unit to prevent the barrier from closing. In other embodiments, the display unit may have additional or different systems for detecting the presence of a person at the display unit and preventing injury to the person (e.g., various types of motion and proximity sensors within or without the display compartment).

Embodiments of the barrier system may include a locking mechanism having a locking member to hold the barrier in a closed position at the receiving surface. Locking mechanisms may be placed in various locations along the track, along the receiving surface, within a recess within the receiving surface, or other locations on the open-air unit. In some embodiments, and without limitation, the locking member of the locking mechanism may be a locking pin, bolt, or other locking means that engages with the barrier when it is in a closed position. The barrier may have a recess therein for receiving a locking member. In some embodiments, and without limitation, the locking mechanism may be an electromechanical device that is controlled by the processing unit, and that engages a locking member when signaled by the processing unit. In other embodiments, and without limitation, the locking mechanism may be a mechanical mechanism (e.g., a latch mechanism) that may require a key or other access device to open once it has been locked. In still further embodiments, and without limitation, the barrier may be locked into position by mechanical components of the barrier system. For example, and without limitation, in embodiments in which the barrier is a rigid structure or includes rigid components (e.g., a steel roll door), the motor of the barrier system may be configured such that it can lock gears, sprockets, and/or other components in position when the motor is stopped such that the barrier is held fast in the tracks in the closed position.

Embodiments of the motor driving the movement of a barrier may include various kinds of motors, such as an AC motor or a servo motor. In embodiments where the barrier is flexible or segmented, the motor may be engaged with a roller or spool that gathers and lets down the barrier. In such embodiments, the motor may be engaged with an axial member (e.g., an axle or drum) of the roller or spool, and may be configured to rotate the axial member in both rotational directions. In other embodiments (e.g., embodiments that do not have a roller or spool), and without limitation, the motor may be engaged with a driving mechanism that runs along the track (e.g., one or more chains or belts) that is engaged with the barrier, and the motor may drive the driving mechanism to pull the barrier along the track. For example, and without limitation, the barrier may be moved along the tracks by a flexible drive element such as chain or belt that is engaged with the barrier by gears or other engagement means. The drive element may be in mechanical connection with and driven by one or more barrier motors.

Embodiments of the open-air units of the present invention may include additional components, such as a battery back-up power source, an operator interface, a security measure for restricting access to a control panel or other control means of the processing unit to authorized operators and personnel, a wireless modem, link or transmitter/receiver for communicating with other computers and electronics, and various other components. Additionally, the processing unit may be in electronic communication with a remote computer by wired or wireless connection. A remote computer may receive constant data from the processing units of one or more open-air units, allowing an operator to monitor multiple open-air units and other vending systems simultaneously. The remote computer may be also operable to remotely control and test various systems of an open-air unit.

Embodiments of the present invention relate to open-air units for displaying food, beverages or other products that include a temperature-controlled compartment having an open side (such as the front) for displaying items and allowing access to the items; a barrier system including a barrier member for covering the open side, and a barrier system motor engaged operable to alternately move the barrier member into a closed position over the open side and an open position retracted onto a spool or into a storage recess; at least one sensor, the at least one sensor configured to measure at least one internal condition of the temperature-controlled compartment; and a processing unit in electronic communication with the at least one sensor and the barrier system motor, the processing unit configured to receive data from the at least one sensor, to compare the data to a pre-determined value or pre-determined range of acceptable values, and to activate the barrier system motor when the data is inconsistent with the pre-determined value or pre-determined range of acceptable values. The at least one internal condition measured by the at least one sensor may include temperature and various other conditions within the compartment (e.g., light conditions, humidity, etc.). Additionally, the processing unit may compare combinations of various conditions to a list of acceptable combinations of data (e.g., combinations of temperature, UV light conditions, humidity, etc.), a matrix of acceptable conditions, or other data storage format stored in an internal memory of the processing unit.

In some embodiments, the present invention relates to open-air units for displaying food, beverages or other products, comprising a temperature-controlled storage compartment having an open side (such as the front) for displaying items and allowing access to the items; a barrier system comprising a barrier member for covering the open side, the barrier member having a track engagement means along at least one side thereof; a track running along at least one border of the open side of the temperature-controlled compartment, the track having a driving means engaged with the track engagement means of the barrier member, and a barrier system motor engaged with the driving means of the track, the barrier system motor operable to move the driving means along the track, and thereby move the barrier member along the track; at least one sensor, the at least one sensor configured to measure at least one internal condition of the temperature-controlled compartment (e.g., temperature); a processing unit in electronic communication with the at least one sensor and the barrier system motor, the processing unit configured to receive data from the at least one sensor regarding the at least one internal condition, and to activate the barrier system motor when the at least one condition of the interior of the temperature-controlled compartment is inconsistent with a pre-determined value or pre-determined range of values stored in an internal memory of the processing unit.

Embodiments of the present invention also relate to methods for automatically locking an open-air temperature-controlled unit, including monitoring a temperature inside an open, insulated compartment of the unit with one or more temperature sensors, wherein the temperature sensors are in electronic communication with a processing unit, which collects and analyzes temperature data from the temperature sensors; comparing the temperature data to pre-determined threshold temperature and time ratios stored in an internal memory of the processing unit; triggering a barrier system to lower a barrier member over an open side (such as the front) of the insulated compartment when the time and temperature ratios are inconsistent with pre-determined acceptable values or a pre-determined acceptable range of values (e.g., higher than a threshold value), wherein the processing unit activates a motor in the barrier system to lower the barrier member; and locking the barrier member in position over a receiving surface at a bottom of the open side of the insulated compartment when the barrier member is in contact or in close proximity to the receiving surface, wherein the processing unit is in electronic communication with the locking mechanism configured to lock the barrier member to the receiving surface.

Some embodiments of the present invention relate to a method of automatically locking an open-air temperature-controlled unit, including monitoring one or more internal conditions (e.g., temperature) inside an open compartment of the open-air temperature-controlled unit with one or more sensors, wherein the sensors are in electronic communication with a processing unit, which collects and analyzes data from the sensors regarding the one or more conditions; comparing the data to pre-determined acceptable values or combinations of values (e.g., threshold time and temperature ratios) stored in an internal memory of the processing unit; and triggering barrier system to lower a barrier member over an open side (such as the front) of the open compartment when the data is inconsistent with the pre-determined acceptable values or combinations of values (e.g., time and temperature ratio is higher than a threshold ratio), wherein the processing unit activates a motor in the barrier system to lower the barrier member. The internal conditions monitored by the processing unit may be one or more of the following: temperature, light, UV light, pressure, humidity, etc. The criteria utilized by the processing unit for activating the lock-out mechanism may include various combinations of the monitored internal conditions received from different kinds of sensors along with other relevant information (e.g., time). For example, the processing unit may include software configured to compare multiple data types taken at given points of time against a list of acceptable combinations of data (e.g., combinations of temperature, UV light conditions, humidity, etc.), a matrix of acceptable conditions, or other data storage format stored in an internal memory of the processing unit for comparison.

Additional variations of the open-air systems are contemplated within the scope of the present invention. For example, and without limitations, the open-air units of the present invention may be adapted to vend items other than food and beverages that need to be maintained at below-ambient temperatures, such as non-prescription medicines, animal feed, certain types of bait, etc. In further variations, the present invention relates to open-air units that are configured to maintain food at a minimum temperature. For example, and without limitation, the presently described open-air display units may be adapted to keep food hot for the purpose of providing warm meals. The open-air units may be used to hold and display hot sandwiches, soups, and other warm foods in appropriate packaging (e.g., foil pouches, insulative cups, etc.) over a limited period of time. In such variations, the units may include largely the same components; however, the refrigeration unit may be replaced with heating elements (e.g., heating lamps, heating coils, etc.), which may be in electronic communication with the processing unit and may be controlled by the processing unit. In such variations, the pre-determined threshold temperature will be a minimum value rather than a maximum value. As previously discussed, the open-air unit may have additional sensors for monitoring other conditions within the open compartment and the processing unit may be configured to monitor and analyze data such additional sensors.

Embodiments of the present invention also encompass additional variations of the barrier system. For example, embodiments of the present invention are not limited to a barrier system having a collection member that is located above an open front of the open-air unit. In some embodiments, collection member may be located below the open front of the open-air unit in a base portion of the open-air unit. In such embodiments, the tracks may have a driving mechanism that runs along one or more of the tracks (e.g., one or more chains or belts) that is engaged with at least a distal end of the barrier and that may be driven by the barrier motor. The barrier motor may drive the driving mechanism to pull the barrier upward along the track. For example, and without limitation, the barrier may be moved along the tracks by a flexible drive element such as chain or belt that is engaged with (1) a sprocket driven by the barrier motor and (2) with the barrier by gears or other engagement means. Also, in such embodiments, the locking mechanism may be located above the open front of the open-air unit, but may operate in substantially the same manner as described above.

In further variations, the barrier may close laterally across the open front of the open-air units. In such embodiments, the elements of the barrier system may be set up to move the barrier from left to right or right to left across the open front of the open-air unit. In such embodiments, the collection member may be positioned on one lateral side (e.g., the left side) of the open-air unit and the receiving surface may be positioned on the other lateral side (e.g., the right side). The tracks may be positioned on the top and bottom borders of the open front of the open-air unit, and the barrier motor may be located adjacent to the collection member or the receiving surface.

In still further variations, the barrier may consist of two doors that open laterally or vertically. In such embodiments the doors may be engaged with linear or curvilinear tracks that run laterally or vertically and allow the doors to be retracted toward the lateral sides or the top and bottom of the open-air unit. In such embodiments, the track may be curvilinear, and run in an arch from the middle front of the open front of the open-air unit to the lateral walls or top and bottom walls inside the open compartment, such that the doors turn about 90° as the pass along the track (e.g., 80° to 120°, or any value therein). Alternatively, the doors may simply slide open laterally or vertically along a linear track, leaving only a partially open front of the open-air unit. In still further embodiments, the barrier may be a pair of accordion doors that may be pulled laterally or vertically along a linear or curvilinear track and collected and bunched on lateral sides or the top and bottom sides of the open display compartment. In other embodiments one or more doors may be hingedly attached to the unit, and closed over the display opening using one or more motors, pistons or other motion imparting mechanisms.

It is therefore an object of the present invention to provide open-air vending apparatus capable of preventing access to the food, beverages or other products therein when certain specified conditions are met, such as excessive temperatures (particularly over longer periods of time), and related methods.

It is also an object of the present invention to provide methods and apparatus for monitoring the temperature or other conditions of open-air storage and display units and for closing off the units when temperatures or other conditions therein reach a predetermined level (e.g., too hot, or too cold).

It is also an object of the present invention to provide protection to vendors and consumers using open-air product storage and display units by preventing access to products in such units if certain pre-determined conditions have been met which may affect product quality.

It is an object of the present invention to provide a food vending apparatus that monitors and records temperature, related data and other conditions within a food storage compartment.

It is an object of the present invention to provide open-air storage and display units that vend food and beverage products in a regulated manner, and that provide more protection to consumers than conventional vending devices from spoiled food and foodborne illness.

It is an object of the present invention to provide an apparatus that can monitor various conditions within a storage and display compartment of an open-air unit, compare the combinations of conditions to a set or matrix of acceptable combinations of conditions to determine whether conditions in the storage and display compartment are acceptable, and restrict or prevent access to the compartment if such conditions are not acceptable.

It is another object of the present invention to provide an open-air storage and vending apparatus that can be monitored remotely by electronic communication with the vending apparatus, and which may be closed off if certain unacceptable conditions are detected.

It is a further object of the present invention to provide a temperature-controlled open-air apparatus having a compartment for displaying and/or vending perishable non-food items such as medications, batteries, fish bait, animal feed, etc. which compartment may be closed off when temperatures or other conditions therein reach a predetermined or unacceptable level.

It is also an object of the present invention to provide an apparatus that can be used to dispense temperature-sensitive food and beverage products in a temperature-controlled environment.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Figure 1A:
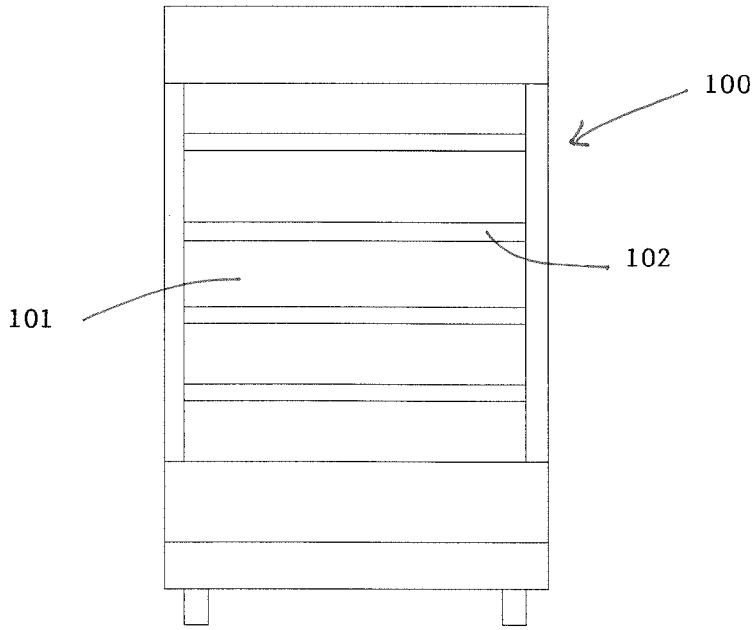
FIG. 1A is a front view of an open-air display apparatus according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. However, it will be apparent to one skilled in the art that the present invention may be practiced without all of these specific details.

The present invention concerns open-air units for displaying, storing, and/or vending food, beverages and/or other perishable products, and methods of using the same. In some embodiments, the presently disclosed apparatuses may take the form of an open-air display unit (e.g., a vending machine having an open face or side) for keeping food and/or beverages at cool temperatures prior to vending, but the present invention is not limited to such implementations. In other embodiments, for example, the open-air units may be adapted to keep food hot for the purpose of providing warm meals. The open-air units of the present invention may also be configured for various applications, such as display, storage, and/or vending of vitamins, medications, batteries, perishable pet foods and animal feeds, perishable animal baits, etc.

The open-air units of the present invention may have one or more open compartments for storing and displaying food and/or beverages (or other items). The compartment may be refrigerated to maintain the food, beverages and/or other products in a desired temperature range to prevent spoilage of the food, beverages and/or other products. The apparatuses may include a refrigeration unit, which may produce cooled air that may be routed by various means to the one or more open food compartments. Ideally, the refrigeration unit is functional to maintain a desired temperature of the food, beverages and/or other products within the apparatus. However, the refrigeration unit may fail to maintain a desired temperature from time to time.

For such eventualities, and optionally for other purposes, the apparatuses of the present invention may include a monitoring system that may include one or more sensors for monitoring temperature and/or other conditions within the one or more food compartments, and a barrier system that can be activated when a temperature and/or other conditions fail to meet certain pre-determined parameters for the operation of the apparatus. The one or more sensors detect the conditions within one or more food compartments of the open-air unit and may provide data to a processing unit. The processing unit may be configured to receive and interpret the data and determine whether the conditions within the open-air unit require that the barrier system be activated.

A barrier system may deter and/or prevent access to the food, beverages and/or other products inside the apparatus when it is activated by the processing unit by positioning a barrier in the closed position over an open compartment storing and displaying the food, beverages and/or other products. The processing unit may be programmable to automatically engage the barrier system under certain conditions, such as pre-determined temperature, time conditions, and/or other parameters. Such apparatuses may be used to control the quality of food, beverages and/or other products provided and/or vended by the apparatus. In some embodiments, the barrier system may include a barrier that is lowered along a track that runs along one or more sides of the open compartment. In the lowered or closed position, the barrier may deter and/or prevent access to the products within the compartment. By deterring and/or preventing access to the products in the compartment, the barrier system may protect consumers from taking and ingesting spoiled or contaminated food, beverages and/or other products, which may lead to discomfort and/or illness. Additionally, the barrier system may assist the vendor of the products in complying with state and federal regulations regarding the handling of food and sanitary practices.

The presently disclosed invention also includes embodiments that are configured for various environments. In some embodiments, the apparatus may be configured for use in an environment in which theft and/or the threat of break-in is not a consideration, such as an employee lounge. In such embodiments, the barrier of the barrier system may be a lighter and/or less rigid material such as a fabric or flexible foam material, a light metal mesh, etc. In some embodiments, the apparatus may be configured for use in an environment in which spoilage warnings may not be understood or heeded or in which theft and/or break-ins are a concern, and the barrier may be designed to prevent theft and/or break-ins (e.g., the barrier may be a rolling steel door, or other rigid, durable barrier).

Exemplary lock-out systems may include a locking mechanism to hold the barrier in position over the open front or side of the open-air unit. In different implementations, the locking mechanism may take different forms. The locking mechanism may be may be electromechanical and controlled by a processing unit of the open-air unit or it may be purely mechanical (e.g., a mechanical latch mechanism).

The various components of the open-air unit (e.g., the refrigeration unit, the heating unit, the sensors, the locking mechanism, the motor of the lock-out system, etc.) may be controlled by and in electronic communication with the processing unit. In some embodiments, and without limitation, the processing unit may be contained within the open-air unit. In other embodiments, and without limitation, the processing unit may be remote to the open-air unit and maybe in electronic communication with the open-air unit by a wired or wireless connection.

Figure 1B:
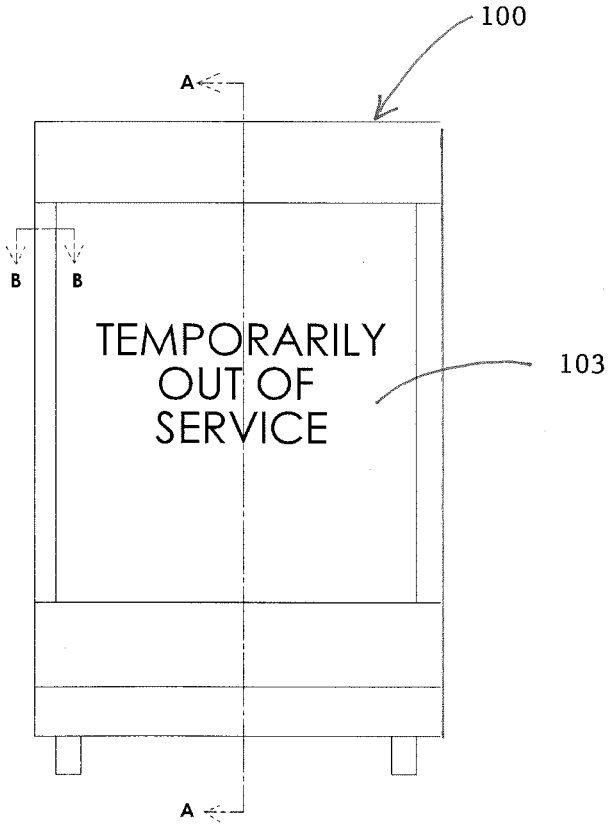
FIG. 1B is a front view of an open-air display apparatus according to an embodiment of the present invention, with a barrier in the closed position.

The above-discussed aspects of the present invention and additional aspects of the present invention are described below in reference to the embodiments illustrated in the accompanying drawings. Referring to the drawings wherein like reference characters designate like or corresponding parts throughout the several views, and referring particularly to the exemplary embodiments of FIGS. 1A-1E, it is seen that these embodiments include an open-air unit 100 having an open front 101 and a barrier 103 that may be lowered into position over the open front 101 (see, e.g., FIGS. 1A-1B). Embodiments of the open-air unit 100 may additionally include a collection mechanism or member 109 for retracting the barrier 103 when the open-air unit is in an open condition, a locking mechanism 107 for locking the barrier 103 in a closed position, a processing unit, and various other components as described herein.

The open-air unit may be implemented for various uses, such as vending foods, beverages, medicines, vitamins, animal feed, certain types of bait, etc. In the exemplary embodiment of FIGS. 1A-1E, the open-air unit 100 may be utilized for food and beverage vending, among other applications. The open air unit may include one or more shelves 102 for holding and displaying food and/or beverages in the open storage area or compartment 101. The open front of the open compartment 101 may allow patrons, customers, employees, and/or other intended parties to freely select and take any food, beverage or other product(s) they choose without the need to open a door or ask for assistance. This aspect of the open-air unit 100 provides convenience and aesthetic appeal over conventional vending machines. The open storage compartment 101 may have various other means of displaying the food and/or beverages therein (not shown), including, and without limitation, hangers, cubbies, rotating platforms, one or more boxes (e.g., boxes having closable doors for items requiring colder temperatures than the other food and beverages in the compartment), etc. The open compartment may have various other features that enhance the presentation and appearance of the food, beverages, and/or other items therein, such as lighting, coloring, decorations, and other visual enhancements.

The temperature of an open-air cooler unit 100 may be maintained by a refrigeration unit (not shown) housed within the open-air unit. The refrigeration unit may be a condenser unit having one or more fans (not shown) for circulating air to the interior of the open compartment 101. The open-air cooler unit 100 may include one or more vents, shafts, and/or baffles (not shown) through which cooled air may be routed to open compartment 101. In some implementations, and without limitation, the one or more vents, shafts, and/or baffles may include one or more shafts that route cooled air to the top of the open front of the compartment 101 and direct the air down in one or more columns or a sheet of cooled air that has a width equal to all or substantially all of a width of the open front of the storage compartment 101. In such implementations, a zone of cool air may be present over the open front of the compartment 101 when the refrigeration unit is operating.

Embodiments of the open-air units of the present invention may include a barrier system which prevents or restricts access to the food, beverages and/or other products in the open-air unit. In the exemplary embodiment shown of FIGS. 1A-1E, the illustrated barrier system may include a barrier 103, at least one track 104 for guiding the barrier 103, a collection member 109 (e.g., a roller) for storing the barrier 103 when the open-air unit is in an open condition, a locking mechanism 107 for locking the barrier 103 in position when the open-air unit is in a closed condition, and a motor (e.g., a tubular motor, a servo motor driving a drum or axle of the collection member, etc.) for driving the movement of the barrier 103 along the track(s) 104 between the collection member 109 and a receiving area 106.

In the exemplary embodiment of FIGS. 1A-1E, barrier 103 is provided in the form of a curtain or sheet of flexible material which may be a metal alloy sheet, a metal mesh, a fabric (e.g., a polymer fabric), a flexible rubber sheet, a flexible foam, or other flexible material, which closes off the open-front compartment 101, thereby indicating to all comers that the food, beverages, and/or other items in the open-air unit are unavailable. For example, and without limitation, the barrier may be retracted to open the front compartment of the open-air unit to allow access, or it may be scrolled down to close the front compartment to prevent access. The barrier may optionally include a message (e.g., "Temporarily Out of Service") or a symbol thereon, indicating that the machine is closed and is not currently vending, or a warning that the products therein may be spoiled. In such embodiments, the barrier is designed to deter a person from taking and ingesting spoiled or contaminated food. The barrier may also be insulative (e.g., a thick polymer fabric or rubber foam) in order to protect the food and/or beverages therein from further spoilage. For example, and without limitation, the open-air unit may include fresh foods that spoil quickly at the temperatures above a pre-determine threshold temperature, but may also include other foods and/or beverages that do not spoil at the threshold temperature and can be salvaged, in which case it is desirable to maintain a cool temperature in the compartment. In other implementations, and without limitation, the barrier may be more substantial (e.g., a rolling steel door, or a plurality of panels), and may have dual functions of (1) restricting access to food in the open-air unit that may be spoiled or contaminated, and (2) locking up the open-air unit at the time the operator of the open-air unit wishes to close to the public.

The barrier 103 may have a bar or other terminating structure 105 at its distal end, which may meet with a complementary structure such as a receiving recess 106 at the bottom of the open front of the compartment 101. In the illustrated embodiment, a receiving recess 106 is provided that is continuous with the tracks 104 forming a pocket-like structure having a shape that is complementary to the shape of bar 105, such that all or a portion of bar 105 may sit within the receiving recess 106 when the barrier 103 is in the closed position. In other implementations, and without limitation, the open-air unit may have a receiving surface without a recess, to which the bar may be guided by tracks 104. The receiving recess or surface 106 may include mechanisms for engaging the bar when the bar is lowered into position adjacent thereto, such as magnets, latches, clips, etc. Such engagement mechanisms may be present in addition to a locking mechanism for locking the bar into position over the receiving recess or surface.

In other embodiments, the barrier may include a terminal structure other than a bar. For example, and without limitation, may include a flat, horizontal plate at its terminal end that may have one or more slots, holes, notches, or other structures that may engage with the receiving recess or surface and/or may be engaged with the locking member of the locking mechanism. In further embodiments, and without limitation, the barrier may not include a terminal structure. For example, and without limitation, in embodiments in which the barrier includes track engagement means along its length coupling it to the track, terminal structure may be omitted. In such embodiments, the motor of the barrier system may be configured such that it can lock gears, sprockets, and/or other components in position when the motor is stopped such that the barrier is held fast in the tracks in the closed position.

The exemplary illustrated bar 105 may have a width such that the bar 105 spans the entire width of the open front of the compartment 101 and also reaches into tracks 104 that may run along the lateral sides of the open front of the compartment 101. The lateral ends of the bar 105 may be nested within the tracks 104. The bar 105 may be rigid (e.g., it may be made from metal, rigid plastic, etc.) and may be fitted to the tracks 104, such that it cannot be removed from the tracks 104 without disassembling the tracks. For example, and without limitation, the bar may be scored on each lateral side thereof with grooves that are complementary to an opening in the track 104 with which the grooves may be engaged. In such implementations, the opening of the track may have a collar running vertically along the length of the track that is narrower than the interior of the track. The bar 105 may include other features to create a secure fit within the tracks 104. For example, and without limitation, the bar may have enlarged lateral ends that sit within the tracks 104 to prevent the bar 105 from being removed from the tracks 104. The bar 105 may also include features that reduce friction with the tracks 104 and allow for a smooth movement along the tracks 104 to prevent sticking or pinching of the bar 105. For example, and without limitation, the bar 105 may have a friction reducing material on the surfaces adjacent to the tracks 104 (e.g., low friction plastics, polytetrafluoroethylene (PTFE) coating, etc.), wheels engaged with the tracks 104, or other friction-reducing elements.

The exemplary illustrated terminating structure 105 may also function as a weight (e.g., in embodiments in which the barrier is made from fabric, rubber sheet, rubber foam, etc.) to maintain the barrier 103 in a vertical orientation when it is being lowered along the tracks 104 and when the barrier 103 is in the closed position. In some embodiments, and without limitation, the lateral edges of the barrier 103 may not be connected to the tracks and may pass through the tracks 104 without contacting the tracks 104. In such implementations, the bar 105 may be engaged with the tracks and may alone guide the movement of the barrier 103 along the tracks 104. In other implementations, and without limitation, the edges of barrier 103 may include track-engagement mechanisms such as rollers, bearings, or other elements (not shown) for engaging the track 104 along which the barrier moves inferiorly to close and superiorly to open. In such embodiments, the track-engagement mechanisms may prevent the barrier from being removed from the tracks 104 (e.g., pulled aside). Without limiting the invention, the track-engagement mechanisms may be utilized in embodiments configured to prevent someone from breaking into the open-air unit.

Figure 1C:
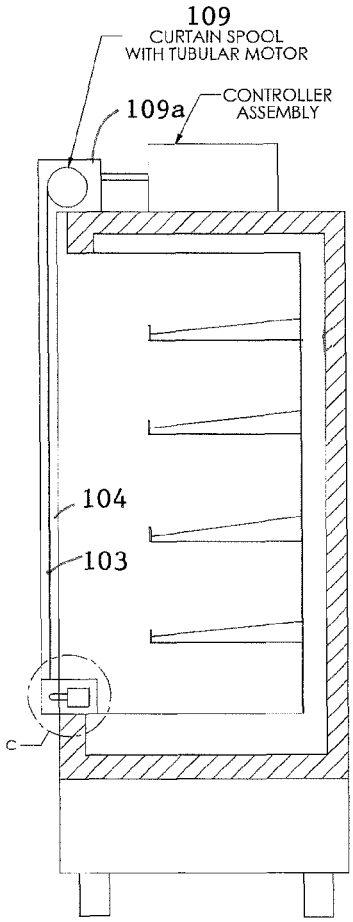
FIG. 1C is a cross-sectional side view of an open-air display apparatus along line A-A of FIG. 2.
Figure 1D:
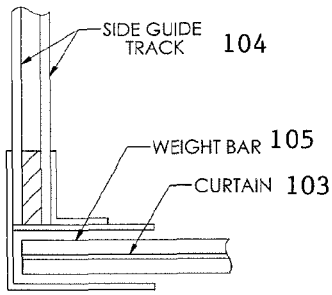
FIG. 1D is a cross-sectional top view of an open-air display apparatus along plane B-B of FIG. 2.
Figure 1E:
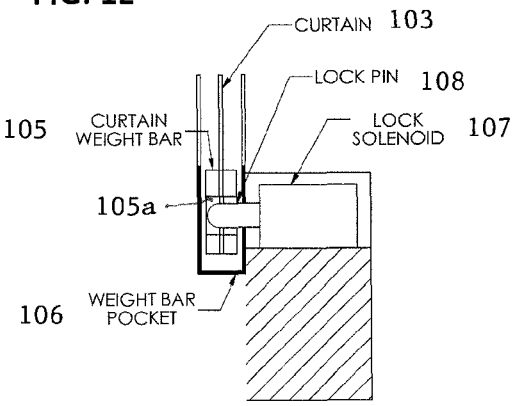
FIG. 1E is an enlarged view of area "C" of FIG. 1C.

The exemplary illustrated terminating structure 105 may include a lock recess 105*a* (e.g., a slot, hole, or other recessed structure) for receiving a locking member 108 from a locking mechanism 107. The recess 105*a* may be complementary to a locking member such that there is a flush or substantially tight connection between the recess 106 and the locking member. FIG. 1E shows a close-up view of a locking mechanism 107 of the exemplary open-air unit 100. The locking mechanism 107 includes a locking member 108 that may be a bolt, pin, rod, or other structure that may be inserted into the lock recess 105*a* to thereby lock bar 105 into the receiving recess 106 and prevent the barrier 103 from being lifted. The locking member may have various textures, notching, protrusions, or other characteristics to help anchor the locking member in the lock recess. In some implementations, without limitation, the lock recess may pass completely through bar, and allow the locking member to pass through the entire thickness of the bar and protrude through the other side of the bar. In such implementations, and without limitation, the bar-receiving recess (e.g., recess 106) may include a surface or recess for receiving and engaging the locking member on an opposite side of the bar from the locking mechanism. Such implementations may provide better stability of the locking member and the bar, better preventing someone from breaking into the open-air unit.

It is to be appreciated that although the illustrated exemplary embodiments of FIGS. 1-1E show a barrier in the form of a flexible curtain 103 having a terminal weighted bar 105, that in other embodiments the barrier 103 may take other forms such as without limitation, a series of panels hingedly attached to each other, metal or sturdy plastic mesh, a plurality of elongated bars separated by small gaps or spaces (too small for products to be pulled through), or other similar structures. It is also to be appreciated that although the illustrated exemplary embodiments of FIGS. 1-1E show a barrier that may be retracted to an upper position and closed when in a lower position, that these may be reversed such that the barrier is refracted when in a lower position, and closed when moved to an upper position. Alternatively, it is to be appreciated that instead of moving up-and-down, embodiments of barriers of the present invention may move from right-to-left or from left-to-right to open and close over an open air unit.

In some embodiments, and without limitation, the locking mechanism 107 may be an electromechanical device that is controlled by a processing unit of the open-air unit 100. For example, and without limitation, the locking mechanism 107 may include a solenoid mechanism, linear actuator, or other electromechanical mechanism capable of extending lock member 108. The processing unit may activate the locking mechanism 107 when the barrier 103 is in the closed position and the terminating structure 105 is in position adjacent to the locking mechanism 107. The processing unit may trigger the locking mechanism 108 to engage in response to various sensors indicating that the terminating structure 105 is in position in the receiving recess 106, such as a proximity sensor in the receiving recess 106 (e.g., a metal detection or optical sensor). In other embodiments, the barrier system motor may include an encoder that is electronic communication with the processing unit and provides sufficient data regarding the position of the terminating structure 105 for the processing unit to determine when the terminating structure 105 reaches the closed position in the receiving recess 106 and is in position to be engaged by the lock member 108.

In other embodiments, and without limitation, the locking mechanism may be purely mechanical (e.g., a locking latch mechanism) and may require a key or other access device to open once it has been locked. In further implementations, and without limitation, the barrier may be locked into position by mechanical components of the barrier system. For example, and without limitation, the barrier system motor may be configured such that it can lock gears, sprockets, and/or other components in position such that the barrier is held fast in the closed position. In such examples, and without limitation, the barrier system motor may be engaged with a driving mechanism that runs along one of the tracks (e.g., a chain or belt) that is engaged with the barrier, and the motor may drive the driving mechanism to pull the barrier along the tracks. The barrier may have one or more gears or other engagement means engaged with the drive element such that the gears are held in place when the barrier system motor is inactive.

As previously mentioned, the barrier system may include collection member 109, and a barrier system motor configured to drive the collection member 109. The collection member 109 may be a roller or spool for collecting the barrier 103. The collection member may be placed in a housing 109*a*, which may hide and protect both the collection member 109 and the barrier 103, when the barrier is retracted leaving the open-air unit in an open position. The tracks 104 may run up to collection member 109, and receive the barrier 103 as it is lowered and comes off of the collection member 109. For example, and without limitation, the tracks 104 may extend into the housing 109*a* such that an unauthorized person cannot tamper with the nested arrangement of bar 105 within the tracks 104. In other embodiments, and without limitation, the barrier may be a single rigid piece of material, such as a curved piece of plastic, glass, or metal, and the collection member may be a chain or belt attached to the barrier and capable of retracting the barrier into a slot in the superior portion of the cooler, for example, along a curvilinear track.

In some embodiments of the invention, the barrier system motor (not shown in FIGS. 1A-1E, see motor 207 in FIG. 2 as an example) may be a reversible motor that is capable of both lowering and raising the barrier 105 along tracks 104. The barrier system motor 207 may be controlled by the processing unit 204, which may be electronic communication with the barrier system motor 207. The barrier system motor 207 may be one of various kinds of electromechanical motors, such as a tubular motor, a servo motor, a stepper motor, etc. The motor may be associated with one or more encoders that may allow the processing unit to have fine control over the position and movement of the collection member 109 and the barrier 103. The barrier system motor may be a tubular motor that may include an exterior collection surface on which the barrier 103 is spooled, or that may be nested within a drum or other structure on which the barrier 103 is spooled. In other implementations, the barrier system motor may be some form of rotary actuator motor (e.g., a stepper motor, a servo motor, etc.) in mechanical communication with the collection member 109 through one or more gears, sprockets, axels, belts chains, etc. In some embodiments, the barrier system motor may be placed in close proximity to the collection member and/or be in direct mechanical communication therewith. For example, and without limitation, the barrier system motor may be positioned within the housing 109*a* and have a driving axle or shaft in mechanical communication with an axle of the collection member (e.g., in embodiments where the collection member is a roller or spool) through one or more gears, chains, belts, etc. In some examples, and without limitation, the barrier system motor may be adjacent to one end of the collection member and have a driving axle or shaft that is in direct mechanical connection with an axle or drum of the collection member. In other embodiments, the barrier system motor may be located outside of housing 109*a* and mechanically connected to the collection member 109 indirectly. For example, and without limitation, the collection member 109 may have an axle connected to the barrier system motor by a chain, belt, gears, or other means. In some examples, and without limitation, the barrier system motor may have a sprocket that is connected to an axle of the collection member by a chain or belt.

As previously mentioned, embodiments of the barrier system motor may be a reversible motor controlled by the processing unit. The processing unit may be operable to control the motor to rotate a drive shaft and/or sprocket thereof in either rotational direction, thereby allowing the processing unit to control the movement of the collection member and the position of the barrier. For example, the processing unit may direct the lock-out system motor to rotate in a first rotational direction, which may cause the collection member to also rotate in the first rotational direction and retract the barrier 103. Additionally, the processing unit may also direct the lock-out system motor to rotate in a second rotational direction, which may cause the collection member to rotate in the second rotational direction and lower the barrier 103 over the open front of the open-air unit 100 to close off the unit in the event of a triggering situation.

The operation of the various electromechanical components of the open-air unit 100 may be controlled by a processing unit that is in electronic communication therewith. The processing unit may allow the operation of the barrier to be automated. The processing unit may be in electronic communication with one or more sensors for monitoring the internal environment of the open-air unit, including one or more of the following: temperature sensor(s), light sensor(s), barometric sensor(s), humidity, sound, motion, etc. The open-air units of the present invention may include additional elements that are typical of refrigerated vending units and that are in electronic communication with the processing unit, such as lighting (e.g., lights to illuminate the interior of the unit, UV lights to limit bacterial growth, etc.), a back-up power supply, etc. The electronic components discussed herein and various other electronic components of the open-air unit may be connected to a power supply and in electronically communication with the processing unit.

The processing unit may be a computer housed within the open-air unit 100; alternatively, the processing unit may be separate from the open-air unit and communicate via wired or wireless means to the sensor(s), motor and other electronics of the open-air unit. For example, and without limitation, the open-air unit 100 may have a controller housing 110 on a top portion thereof, as shown in FIG. 1C. The controller housing 110 may house the processing unit and additional electronics or circuitry, such as a battery back-up power source, an operator interface (e.g., a touchscreen, a digital display, command entry keys, and/or other features that may allow an operator to input various commands), a security measure for restricting access to control of the processing unit (e.g., a credential system for reading security badges, access fobs, biometrics, etc.), a wireless modem or other link for communicating with other computers and electronic devices, and various other components. Additionally, the wiring from the electromechanical and electronic components of the open-air unit 100 (e.g., the barrier system motor, the locking mechanism 107, the refrigeration unit, the sensors, etc.) may be routed into the controller housing 100, to facilitate connection of the electromechanical and electronic components to the processing unit.

Figure 2:
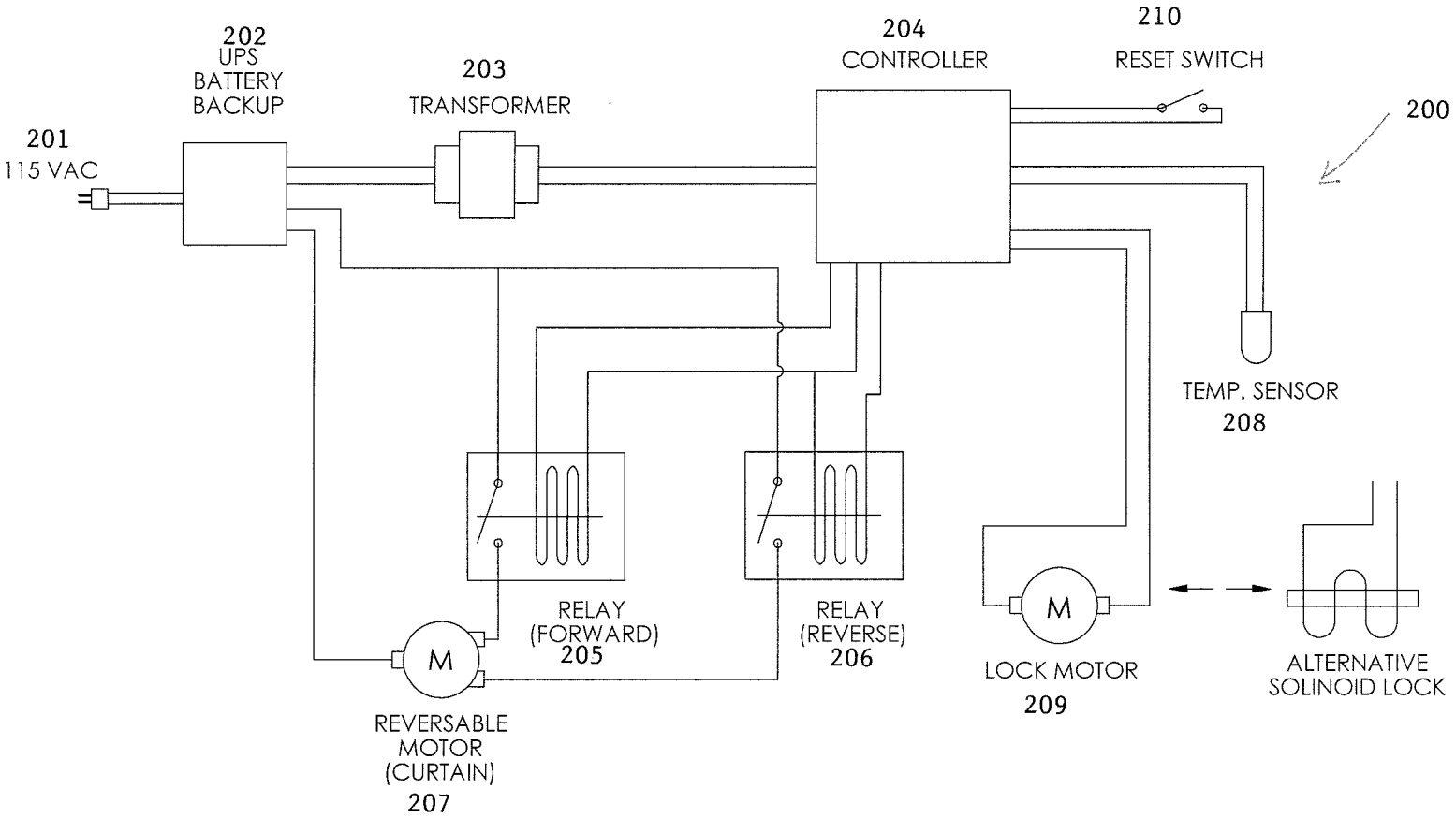
FIG. 2 is a block diagram of an embodiment of an open-air display unit of the present invention.

As a non-limiting example of a circuit system for an open-air unit of the present invention, FIG. 2 shows a system circuit plan 200 for an open-air unit (e.g., the exemplary open-air unit 100 of FIGS. 1A-1E). The circuit 200 includes a plug 201 for connecting to a power source (e.g., a 115 VAC, 60 Hz power source; a 220 VAC, 60 Hz power source power source; etc.), a back-up power battery 202 (e.g., an uninterruptible power supply battery, to allow the open-air unit to shut down properly and lower the barrier into a closed position), a transformer 203, the processing unit 204, relay circuit portions 205 and 206 connected to the barrier system motor 207 (e.g., the relay circuits may allow the processing unit 204 to run the barrier system motor 207 in both rotational directions, allowing the movement of the motor 207 to lower and lift the barrier), a temperature sensor 208, a locking mechanism 209, and a reset switch 210 (e.g., for preventing damage to the electronics by cutting power to the processing unit in the case of a power surge).

The exemplary circuit system 200 of FIG. 2 demonstrates that the processing unit 204 is connected to each of the electronic components of the open-air unit, and thus controls and coordinates the operation of the components. The present invention is not limited by the exemplary circuit system 200 of FIG. 2, and it is to be understood that the circuit system of the open-air units of the present invention may include additional electronic elements, such as a refrigeration unit, a heating unit, additional sensors, lighting, a modem or other link for communication with a remote computer, and other elements that are in electronic communication with the processing unit, as discussed herein.

Embodiments of the processing unit may include software capable of comparing the data from the one or more sensors to one or more pre-determined standards stored in an internal memory, allowing the processing unit to analyze data provided by the sensors (e.g., temperature data) and activate the barrier system when the sensor data indicates that the conditions in the open-air unit 100 are unacceptable. For example, and without limitation, the processing unit or controller may compare temperature data received from temperature sensors in the open-air unit 100 to a threshold temperature stored in the internal memory of the processing unit. A temperature higher than the threshold temperature may indicate that the food and/or beverages stored in an open-air unit 100 may begin to spoil, and the processing unit may be programmed to activate the automated barrier system when it receives temperature data above the threshold.

Embodiments of the processing unit may be programmed to monitor more than temperature alone (e.g., it may monitor UV light conditions, humidity, etc.), and the criteria for activating the lock-out mechanism may include various combinations of different kinds of data (e.g., temperature, UV light conditions, humidity, etc.) received from different kinds of sensors along with other relevant information (e.g., time).

The software may be configured to compare multiple data types taken at given points of time against a list of acceptable combinations of data (e.g., combinations of temperature, UV light conditions, humidity, etc.), a matrix of acceptable conditions, or other data storage format stored in an internal memory of the processing unit for comparison. For example and without limitation, if high UV light readings are detected over a given period of time (e.g. sunlight is entering the unit and reaching the products therein), even though air temperature readings may be within normal levels during that same time, the matrix of conditions may indicate that the products inside the unit have been affected and may automatically cause the unit to close.

In addition to monitoring the conditions within the open-air unit, processing units of the present invention may also be configured to store temperature data in the internal memory of the processing unit, along with data correlated to the temperature, such as the time of each internal temperature reading, the exterior temperature at the time of each internal temperature reading, light conditions (e.g., in systems that include light meters or sensors) at the time of each temperature reading, activity of the refrigeration unit of the open-air cooler at the time of each internal temperature reading, and various other data. The additional data may be used by an operator to determine the possible causes of the failure to maintain a temperature below the pre-determined threshold (e.g., excessive external temperature), the temporal length of the failure (e.g., allowing the operator to determine whether all or some of the food and/or beverages within the open-air cooler need to be discarded), the internal temperature during the period of the failure (e.g., certain beverages and other goods may be salvaged if they may be properly stored at a temperature above the pre-determined threshold temperature), etc.

In some embodiments, and without limitation, the processing unit may store multiple sets of pre-determined acceptable conditions, where each set is designed for a different combination or group of food, beverage, or other types of goods to be displayed in the unit. For example, and without limitation, a first set of pre-determined acceptable conditions may be designed for dairy products, including milk, yogurt, and various cheeses, and a second set of pre-determined acceptable conditions may be designed for pre-packaged sandwiches. The first and second sets of pre-determined acceptable conditions may have different combinations of temperature, light, humidity, and other conditions that are tailored to the type or combination of perishable goods for which the pre-determined conditions were designed.

In further embodiments, and without limitation, the processing unit may be programmed to close the barrier at specific times of day, or after a specific duration of time, without consideration of the internal conditions of the unit. This function may be in absence of or in addition to the processing units function of monitoring the internal conditions of the display unit and the automatic closure of the barrier when the internal conditions of the display unit are inconsistent with pre-determined acceptable conditions.

In further embodiments, and without limitation, the processing unit may be in electronic communication with a remote computer by wired or wireless connection. The remote computer may receive constant data from the processing unit, allowing the computer to record and monitor the data received by the processing unit. In such embodiments, multiple open-air units and other vending systems may be simultaneously monitored and any malfunctions may be quickly noted and addressed by an operator. The remote computer may be operable to control and test various systems of an open-air unit. The electronics of the refrigeration unit, heating unit, the lock-out system motor, locking mechanism, and/or other elements may be remotely tested. In alternative embodiments, and without limitation, the electromechanical components of the open-air unit may be in electronic communication with and controlled by a remote computer having a wired or wireless connection to the electronics of the open-air unit.

By way of an exemplary use, a set of pre-determined temperature and/or other criteria are provided to the processing unit to establish one or more thresholds or triggers (e.g. a high temperature for a given period of time) for closing the open-air unit. This information may include a matrix of potential combinations of time, temperature, humidity, lighting, or other conditions establishing multiple triggers for closing the open-air unit. Once these criteria are established and programmed into the processing unit, sensor data is received from the open-air unit and monitored by the processing unit. For example and without limitation, temperature readings may be received and monitored by the processing unit every minute, or every five minutes, etc. If a threshold or other trigger is identified from the sensor data received by the processing unit (e.g., the temperature has exceeded a maximum for a certain period of time), the processing unit will automatically send a signal to close and lock the barrier. This may be in the form of activating a motor which causes a barrier screen to close over the open front of the open-air unit. The processor may know that the screen is fully extended and reaches the terminal edge of the open front of the unit using data from one or more sensors which provide the position of the screen, from an encoder on a motor driving the screen, or by other means. Once the screen is closed over the open front of the open-air unit, the processor may send another signal to lock the screen in place, such as activating a solenoid which inserts a locking pin into a receiving opening in the barrier screen. It is to be appreciated that the processor is also capable of reversing these functions in order to open the screen. The processor may also be programmed to automatically close (and lock) the screen at certain times of day (e.g., from midnight to 6:00 am daily), and reopen the screen at other times.

The present invention concerns open-air display and vending apparatuses that include an automated barrier system. The barrier system may be activated by a processing unit when the conditions within the apparatuses are unacceptable for food, beverage or other product storage. The open-air display and vending apparatuses described herein may deter and/or prevent customers, employee, etc. from consuming spoiled or contaminated food, beverages or other perishable products stored and displayed in the apparatus, without the need for intervention by a human operator. The invention also relates to methods of operating such apparatuses. The open-air display and vending apparatuses and methods described herein beneficially provide food and beverage safety measures that are automatic and that provide economies and efficiencies to food and beverage and perishable product vendors.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

It is to be understood that variations and modifications of the present invention may be made without departing from the scope thereof. It is to be appreciated that the features disclosed herein may be used different combinations and permutations with each other, all falling within the scope of the present invention. It is also to be understood that the present invention is not to be limited by the specific embodiments disclosed herein, but only in accordance with the appended claims when read in light of the foregoing specification.

What is claimed is:

1. An open-front unit for displaying food, beverages, and other items, comprising:

a. a temperature-controlled compartment for storing and displaying a plurality of items, said compartment having an open front allowing access to said plurality of items;

b. a barrier system comprising i. a barrier for covering said open front, and ii. a motor engaged with said barrier for opening or closing said barrier over said open front;

c. at least one sensor for measuring at least one internal condition of said temperature-controlled compartment; and d. a processing unit in electronic communication with said at least one sensor and said motor, for receiving data from said at least one sensor, comparing said data to a pre-determined range of acceptable values, and activating said barrier system motor when said data is inconsistent with said pre-determined range of acceptable values, wherein said barrier is maintained in an open position during normal operation and said barrier is closed by activation of said barrier system motor when said data is inconsistent with said predetermined range of acceptable values.

2. The apparatus of claim 1, further comprising a locking mechanism for engaging and locking said barrier in a closed position over said open front of said temperature-controlled compartment.

3. The apparatus of claim 2, wherein said locking mechanism is positioned at or near a receiving surface at a bottom of said open front of said temperature-controlled compartment, and said receiving surface has a shape that is complementary to a bottom edge of said barrier.

4. The apparatus of claim 3, wherein said processing unit is in electronic communication with said locking mechanism and is configured to automatically engage said locking mechanism with said barrier when said barrier is in said closed position over said receiving surface.

5. The apparatus of claim 3, wherein said barrier includes a receiver for receiving a locking member of said locking mechanism.

6. The apparatus of claim 5, wherein said processing unit is in electronic communication with said locking mechanism to automatically activate said locking mechanism to engage said locking member with said receiver when said barrier is in said closed position over said receiving surface.

7. The apparatus of claim 1, wherein said barrier comprises a flexible curtain.

8. The apparatus of claim 1, wherein said barrier comprises a sectional door having rigid sectional members.

9. The apparatus of claim 1, further comprising a barrier collection member, wherein said motor is mechanically connected to said barrier collection member.

10. The apparatus of claim 9, wherein said barrier collection member comprises a spool for collecting the barrier.

11. An open-front display unit, comprising:

a. a temperature-controlled compartment having an open front side for displaying a plurality of items and allowing access to said plurality of items;

b. a barrier system comprising a barrier for covering said open front side, a barrier collection member connected to said barrier, and a barrier system motor engaged with said barrier collection member, wherein said barrier is maintained in an open position during normal operation;

c. a locking mechanism for engaging said barrier when said barrier is in a closed position covering said open front side of said temperature-controlled compartment;

d. at least one sensor for measuring an internal temperature of said temperature-controlled compartment; and e. a processing unit in electronic communication with said at least one sensor and said barrier system motor, said processing unit configured to receive internal temperature data from said at least one sensor and to activate said barrier system motor to close said barrier over said open front side when said internal temperature of said temperature-controlled compartment is inconsistent with a pre-determined range of acceptable temperature values.

12. The apparatus of claim 11, further comprising a track running along at least one side of said open front side of said temperature-controlled compartment.

13. The apparatus of claim 12, wherein said barrier comprises a rigid distal member engaged with said track.

14. The apparatus of claim 13, wherein said rigid distal member comprises a receiver for receiving a locking member from said locking mechanism when said barrier is in said closed position over the open front side of the temperature-controlled compartment.

15. The apparatus of claim 14, wherein said locking mechanism is in electronic communication with said processing unit, and said processing unit is operable to activate said locking mechanism to engage said locking member with said receiver.

16. The apparatus of claim 14, wherein said barrier system motor is also operable to position said barrier in an open position such that the open front side of said temperature-controlled compartment is exposed.

17. A method of automatically locking an open-front display unit, comprising:

a. monitoring a temperature inside a temperature-controlled compartment having an open front side that allows access to a plurality of items stored and displayed therein, wherein said temperature is monitored with one or more temperature sensors and said temperature sensors are in electronic communication with a processing unit which collects and analyzes temperature data from said one or more temperature sensors;

b. comparing said temperature data to a pre-determined range of acceptable temperature values, wherein said processing unit compares said temperature data to said pre-determined range of acceptable temperature values stored in an internal memory of said processing unit;

c. positioning a barrier over said open front side of said temperature-controlled compartment by said processing unit activating a barrier system motor to move said barrier when said temperature is inconsistent with said pre-determined range of acceptable temperature values, wherein said barrier is maintained in an open position when said temperature is within said pre-determined range of acceptable temperature values; and d. locking said barrier in a closed position over said open front side of said temperature-controlled compartment, wherein said processing unit is in electronic communication with a locking mechanism for locking said barrier in said closed position over said open side.

18. The method of claim 17, further comprising transmitting said temperature data to a remote computer.

19. The method of claim 17, wherein said barrier system motor is connected to an encoder that provides data regarding the position of said barrier to the processing unit, allowing said processing unit to determine when said barrier is in said closed position over said open front side of said temperature-controlled compartment and in proximity to said locking mechanism.

20. The method of claim 17, wherein a proximity sensor is located near said locking mechanism and is in electronic communication with said processing unit, and said proximity sensor sends proximity data to said processing unit when said barrier is in close proximity to said locking mechanism.

21. The method of claim 20, wherein said processing unit automatically activates said locking mechanism when it receives said proximity data from said proximity sensor.

22. A method of deterring consumers from removing items from an open-front display unit, comprising:

a. monitoring at least one environmental condition inside a temperature-controlled compartment of said open-front display unit with at least one sensor for detecting environmental conditions in said open-front display unit, wherein said at least one sensor is in electronic communication with a processing unit, which collects and analyzes data from said at least one sensor, and said open-front display unit has an open front side that allows access to a plurality of items stored and displayed in said temperature-controlled compartment;

b. said processing unit comparing said data to at least one pre-determined acceptable set of environmental conditions stored in an internal memory of said processing unit; and c. said processing unit activating a motor mechanically connected to a barrier to move said barrier to a closed position over said open front side of said temperature-controlled compartment to close said temperature-controlled compartment when said data is inconsistent with said at least one pre-determined acceptable set of environmental conditions, wherein said barrier is maintained in an open position allowing access to said temperature-controlled compartment when said data is consistent with said at least one pre-determined acceptable set of environmental conditions.

23. The method of claim 22, further comprising the step of said processing unit activating a locking mechanism to lock said barrier in said closed position.

24. The method of claim 23, wherein said motor is connected to an encoder that provides position data regarding the position of said barrier to the processing unit, allowing said processing unit to determine when said barrier is in said closed position and in proximity to said locking mechanism.

25. The method of claim 23, wherein a proximity sensor is located near said locking mechanism and is in electronic communication with said processing unit, and said proximity sensor is triggered and sends proximity data to said processing unit when said barrier is in close proximity to said locking mechanism.

26. The method of claim 25, comprising the additional step of said processing unit automatically activating said locking mechanism when it receives said proximity data from said proximity sensor.

* * * * *